United States Patent [19]

Scherrer

[11] 4,196,580

[45] Apr. 8, 1980

[54] ELECTRONIC WATCH HAVING CORRECTION MEANS

[75] Inventor: Igor Scherrer, Colombier, Switzerland

[73] Assignee: Ebauches S.A., Neuchâtel, Switzerland

[21] Appl. No.: 930,499

[22] Filed: Aug. 3, 1978

[30] Foreign Application Priority Data

Aug. 9, 1977 [CH] Switzerland ..... 9723/77

[51] Int. Cl.[2] ..... G04F 3/02; G04F 8/02

[52] U.S. Cl. ..... 368/187; 368/73; 368/74; 368/228; 368/118; 235/92 PE; 235/92 T

[58] Field of Search ..... 58/4 A, 23 R, 50 R, 58/85.5,21.13, 38 RA, 58, 39.5, 50 A, 74; 234/92 T, 92 TF, 92 PE; 324/186

[56] References Cited

U.S. PATENT DOCUMENTS

| | | | |
|---|---|---|---|
| 3,866,406 | 2/1975 | Roberts | 58/85.5 |
| 4,095,406 | 6/1978 | Kikuchi | 58/85.5 |
| 4,123,896 | 11/1978 | Asano et al. | 58/39.5 |

*Primary Examiner*—Edith S. Jackmon

*Attorney, Agent, or Firm*—Silverman, Cass & Singer, Ltd.

[57] ABSTRACT

An electronic watch is set to the proper time by correction of the content of counters of the watch through the actuation of one or both of two switches. The actuation of the first one of the switches selects whether the content of the counters is to be incremented or decremented at a first speed. The subsequent actuation of the other switch performs the correction at a second higher speed in the sense selected by actuation of the first switch.

1 Claim, 1 Drawing Figure

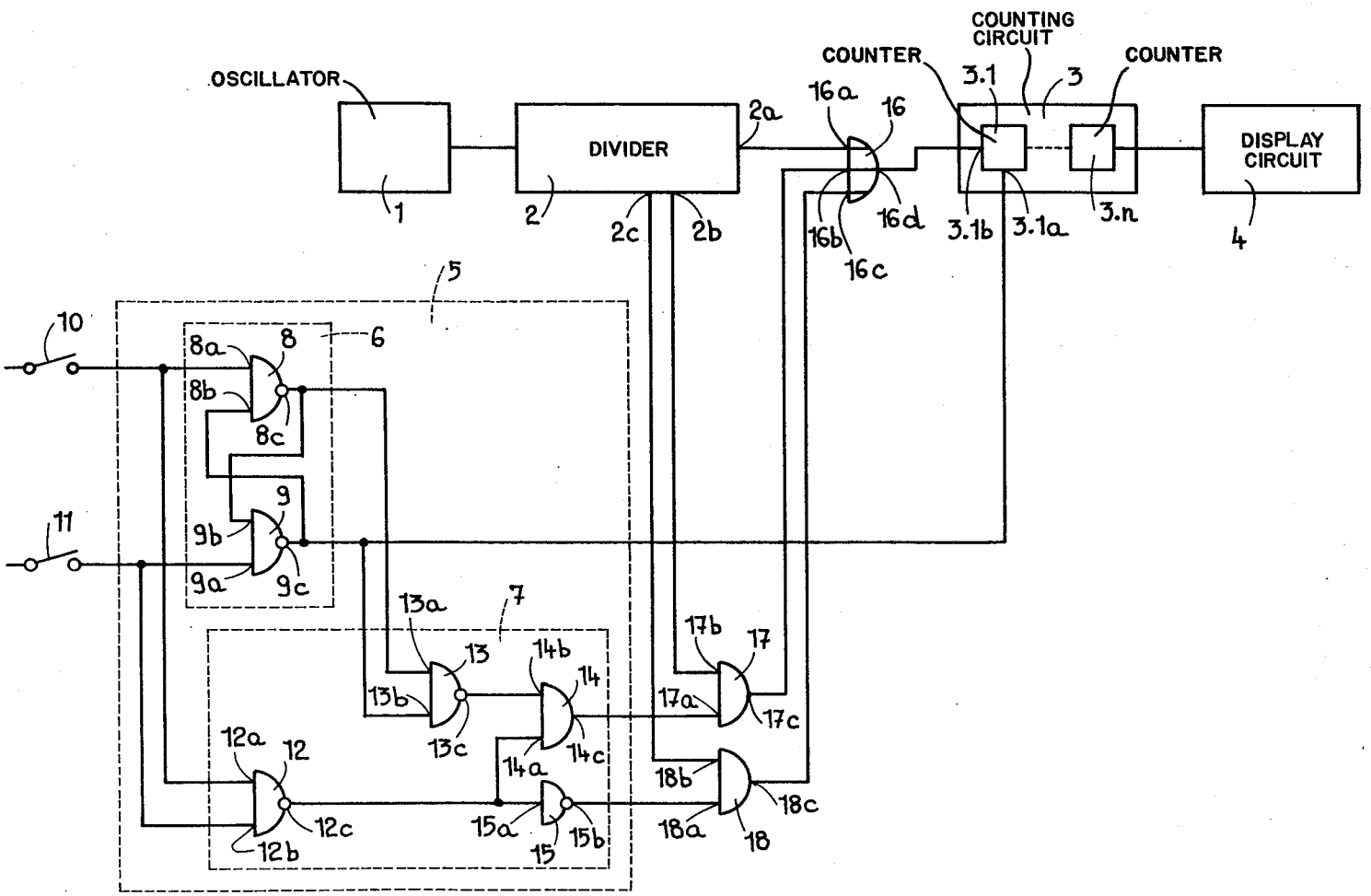
OSCILLATOR
1
DIVIDER
2
2a
2b
2c
COUNTER
16
16a
16b
16c
16d
COUNTING CIRCUIT
3
3.1
3.1a
3.1b
3.n
COUNTER
DISPLAY CIRCUIT
4
5
6
7
8
8a
8b
8c
9
9a
9b
9c
10
11
12
12a
12b
12c
13
13a
13b
13c
14
14a
14b
14c
15
15a
15b
17
17a
17b
17c
18
18a
18b
18c

ELECTRONIC WATCH HAVING CORRECTION MEANS

BACKGROUND OF THE INVENTION

The present invention relates to an electronic watch comprising an oscillator used as a time base, a frequency divider, display means of the time information and two contacts, which are manually operated to correct the time information.

In spite of their great precision, electronic watches must be reset from time to time. Even though this operation does not give rise to many problems to the user of a watch provided with an analog or mechanical display the hands of which can be moved by means of a mechanism similar to the control devices of mechanical watches, it becomes rather difficult in the case of watches provided with digital displays. As a matter of fact, in such watches, the control stem is generally replaced, for reason of simplification of the construction of the watch, by push buttons. Consequently, the user must, for correcting time indications given by such a watch, operate several push buttons in a determined order for, first, making a selection of the counter to be corrected, and then, effecting the correction itself. This last operation, depending on its importance, can take a rather long time.

This slowness is tolerable only as long as the display of the hour is to be corrected, which correction must be made only at long or infrequent intervals of time. However, in the case of a watch provided with an alarm circuit, these manipulations have to be made each time one desires to adjust the time at which the alarm has to be released or sounded and, consequently, they need to be made at short intervals of time. The user of such a watch risks discouragement and giving up using the alarm circuit of his watch.

The object of the present invention is to simplify and to accelerate the operations of modification of the information contained in at least one of the counters of an electronic watch provided with at least two push buttons.

SUMMARY OF THE INVENTION

To this effect, the electronic watch according to the invention is characterized by the fact that it includes a locking circuit arranged in such a way as to transmit to its first or second outputs respectively, a signal delivered by a first or second contact operated alone, and to prevent, when one of the contacts is operated and maintained while the other contact is subsequently operated, the transmission of the signal delivered by the other contact. The watch also includes a logic circuit arranged in such a way as to deliver at its first output a signal when one or the other of the contacts is operated alone, and to deliver at its second output a signal when, while one of the contacts is being operated and maintained, the other contact is subsequently operated. When operating one of the contacts alone, one modifies the watch counter information at a first speed, in a sense determined by the choice of the one contact. When operating the other contact while the first contact is being maintained operated, one modifies the watch counter information at a second speed, the sense of the modification remaining that which had been previously determined by the choice of the first contact.

BRIEF DESCRIPTION OF THE DRAWING

The drawing shows, by way of example, one embodiment of the invention.

The sole FIGURE represents the block diagramm of an electronic watch including means allowing modification of the information contained in its counters.

DESCRIPTION OF THE PREFERRED EMBODIMENT

This FIGURE shows an oscillator 1 used as a time-base and delivering a signal of a relatively high frequency such as, for instance, 32 kHz. The resonator which is associated with this oscillator generally consists of a piezo-electric quartz crystal.

The frequency of this signal is divided by a divider 2 which delivers at its output 2*a* a signal of a relatively low frequency, adapted to a counting circuit 3 including several counters 3.1, . . . , 3.n intended to count the minute, the hour, etc. The outputs of these counters control a display circuit 4.

An electronic circuit 5, intended to allow modification of the information contained in the counters, consists of a locking circuit 6 and of a logic circuit 7.

The locking circuit 6 is formed, in the example disclosed and represented, by two NAND gates 8 and 9. The first inputs 8*a*, and 9*a*, of these gates respectively are connected by non-represented adapting circuits to contacts 10 and 11, operated by the push buttons of the watch, so that a logic state 0 is present at these inputs when the contacts are opened and a logic state 1 is present when the contacts are closed. The second inputs 8*b*, and 9*b*, respectively of these gates are connected to the outputs 9*c*, and 8*c*, respectively of these same gates.

It is to be noted that, in spite of their appearance, these two gates 8 and 9 do not constitute an R-S flip-flop. As a matter of fact, the inputs 8*a* and 9*a* are both at the logic state 0 when the contacts 10 and 11 are opened and the outputs 8*c* and 9*c* are consequently both at the logic state 1. When the user closes the contact 10, for instance, the output 8*c* of the gate 8 passes to the logic state 0 and remains therein as long as the contact 10 is maintained closed. If the contact 10 is reopened, this output 8*c* passes again immediately to the logic state 1. Moreover, as long as this contact 10 remains closed, the output 9*c* of the gate 9 is maintained at the logic state 1, even if the user closes the contact 11.

The operation is the same if the user closes first the contact 11, but, this time, it is the output 9*c* of the gate 9 which passes to the logic state 0, which prevents the output 8*c* of the gate 8 from passing also to the logic state 0 if the user closes the contact 10.

When the contacts 10 and 11 are opened anew, the output 8*c* or 9*c* which was at the logic state 0 passes again immediately to the logic state 1. Consequently, there is no memory effect.

The logic circuit 7 consists of NAND gates 12 and 13, an AND gate 14 and an inverter 15. The inputs 12*a* and 12*b* of the gate 12 are connected, as are the inputs 8*a* and 9*a* of the gates 8 and 9, to the contacts 10 and 11. The inputs 13*a* and 13*b* of the gate 13 are connected, respectively, to the outputs 8*c* and 9*c* of the gates 8 and 9; the gate 14 has its inputs 14*a* and 14*b* respectively, connected to the outputs 12*c* and 13*c* of the gates 12 and 13. The inverter 15 has its input 15*a* also connected to the output 12*c* of the gate 12.

As long as the contacts 10 and 11 are opened, the output 12*c* of the gate 12 is at the logic state 1, while the output 13*c* of the gate 13 is at the logic state 0. Consequently, the outputs 14*c* of the gate 14 and 15*b* of the inverter 15 are at the logic state 0.

When the user closes one of the contacts 10 or 11 only, the output 12*c* of the gate 12 remains at the logic state 1, and the output 15*b* of the inverter 15 at the logic state 0. The output 13*c* of the gate 13, on the other hand, and consequently the output 14*c* of the gate 14, pass to the logic state 1. If the user then closes the second contact, while maintaining the first one closed, the output 12*c* of the gate 12 passes to the logic state 0. Consequently, the output 14*c* of the gate 14 passes also to the logic state 0, and the output 15*b* of the inverter 15 passes to the logic state 1. When the user releases the two push-buttons whereby the contacts 10 and 11 are reopened, the outputs 14*c* of the gate 14 and 15*b* of the inverter 15 pass again to or remain at the logic state 0.

An example of the utilization of this circuit is also represented in the drawing. It has been admitted, in this example, that the watch is simple and that only one of its counters, i.e. the counter 3.1, can be corrected. This counter 3.1 is arranged in such a way as to be able to count forward and backward, the sense of counting being determined by the logic state of its input 3.1*a*. A logic state 1 produces the counting ahead forward, that is to say the increment by one unit of the content of the counter at each pulse arriving at its counting input 3.1*b*. A logic state 0 at its input 3.1*a* produces the counting backward, that is to say the decrement of the content of the counter by unity at each pulse arriving at its input 3.1*b*.

This input 3.1*a* is connected to the output 9*c* of the NAND gate 9, which constitutes one of the outputs of the locking circuit, the other one being constituted by the output 8*c* of the NAND gate 8 and being not used in this example. An OR gate 16 is interposed between the output 2*a* of the divider 2 and the input 3.1*b* of the counter 3.1 by its input 16*a* and its output 16*d*. Its two other inputs 16*b* and 16*c* are connected, respectively, to the outputs 17*c* and 18*c* of two AND gates 17 and 18. The first inputs 17*a* and 18*a* of gates 17 and 18 respectively, are connected to the outputs 14*c* of the gate 14 and 15*b* of the inverter 15, which constitute the two outputs of the logic circuit 7. The second inputs 17*b* and 18*b* of these gates 17 and 18 are connected, respectively, to two intermediary outputs 2*b* and 2*c* of the divider 2 which deliver pulses of a frequency of, for instance, 2 Hz for the first one and 32 Hz for the second one.

It appears that, when the user closes the contact 10 only, the input 3.1*a* of the counter 3.1 remains at the logic state 1. The output 14*c* of the gate 14, on the other hand, passes to the logic state 1, which allows the pulses delivered by the output 2*b* of the divider 2 to reach, by the intermediary of the gates 17 and 16, the counting input 3.1*b* of the counter 3.1. Consequently, the content of this counter is incremented by two units per second as long as the user maintains the contact 10 closed. If, the user then closes the contact 11, while continuing to operate the contact 10, the output 14*c* of the gate 14 passes to the logic state 0 and the output 15*b* of the inverter 15 passes to the logic state 1. Consequently, the pulses delivered by the output 2*c* of the divider 2 reach, by the intermediary of the gates 18 and 16, the counting input 3.1*b* of the counter 3.1. Consequently, the content of the latter is incremented at the rate of 32 pulses or units per second.

If the user would have closed the contact 11 first, the input 3.1*a* for selecting the sense of the counting of the counter 3.1 would have passed to the logic state 0, which would have produced the reduction of the content of this counter, at the rate of two units per second if the contact 11 alone was closed, or of 32 units per second if the contact 10 has been closed later.

The circuit hereinabove disclosed might also be used in a watch provided with a step by step bidirectional motor driving the second, minute and hour hands, such as the motor which is disclosed, with some examples of control circuits, in Swiss Patent Application No. 10.768/77. It would be sufficient, to this effect, to replace, respectively, the counting circuit 3 and the display circuit 4 of the present application with the driving circuit 3 and the motor 4 of the application hereinabove mentioned and to connect the output 9*c* of the present application to the output 3*c* of the cited application. With this combination of circuits, the user could cause the second hand of his watch to go forward or backward at the rate of two divisions of the dial per second when one of the contacts 10 or 11 alone is closed, and at the rate of 32 divisions per second by closing thereafter the other contact.

The user thus has at his disposal a simple and efficient means for modifying the content of the counters of his watch. While pressing only one of the push buttons, he modifies this content relatively slowly. If the modification to be effected is great, he can increase the speed thereof by pressing the other push button. When the display of the watch indicates that the desired value is almost reached, he releases the second push-button for finishing, if necessary, the correction at low speed. If he goes beyond the desired value, he can return thereto by pressing the other push-button. The operation can still be simplified by a marking of the push-buttons by means of symbols such as "+" and "−" printed on the dial of the watch or on its casing.

The above mentioned example has been voluntarily made simple. It is obvious that, in a watch, all the counters must be able to be corrected individually. It would be the same with the counters of the alarm circuit of an alarm watch or with the counters of any other circuit which could be combined with the watch. Consequently, the watch must be provided with a circuit of selection of the counter to be corrected, which has not been represented in the drawing for the sake of simplification. This selector might, as a matter of fact, be controlled by the same push buttons as the disclosed circuit.

It is also obvious that this circuit might be constituted differently for performing the same functions, and that the frequencies of the signals used for executing the correction might be different, without departing from the scope of the invention.

What I claim is:

1. An electronic watch comprising:

oscillator means for generating time base signals at several frequencies;

counter means for counting said time base signals, said counter being able to increment and decrement its count in response to respective increment and decrement control signals, and to count at several frequencies of said time base signals;

increment switch means for applying an increment control signal to said counter means when actuated;

decrement switch means for applying a decrement control signal to said counter means when actuated;

lock means for locking the counter means in the increment or decrement count condition in response to actuation of the first one of the switch means whether or not the other switch means is subsequently actuated, first logic means for applying a time base signal at a first frequency to said counter means in response to the actuation of the first one of said increment and decrement switch means; and second logic means for applying a time base signal at a second frequency higher than said first frequency, in response to the subsequent actuation of the other of said switch means while the first one of said switch means is maintained actuated.

* * * * *